US011062647B2

(12) United States Patent
Hwang et al.

(10) Patent No.: US 11,062,647 B2
(45) Date of Patent: Jul. 13, 2021

(54) DISPLAY DEVICE AND METHOD OF DRIVING THE SAME

(71) Applicant: Samsung Display Co., Ltd., Yongin-si (KR)

(72) Inventors: Jun-Ho Hwang, Asan-si (KR); Yun Ki Baek, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 131 days.

(21) Appl. No.: 16/196,795

(22) Filed: Nov. 20, 2018

(65) Prior Publication Data

US 2019/0156739 A1 May 23, 2019

(30) Foreign Application Priority Data

Nov. 22, 2017 (KR) ..... 10-2017-0156564

(51) Int. Cl.

| | |
|---|---|
| ***G09G 3/36*** | (2006.01) |
| ***G09G 3/3225*** | (2016.01) |
| ***G09G 3/20*** | (2006.01) |

(52) U.S. Cl.

CPC ..... *G09G 3/3225* (2013.01); *G09G 3/20* (2013.01); *G09G 3/3648* (2013.01); *G09G 2310/0232* (2013.01); *G09G 2310/0264* (2013.01); *G09G 2360/16* (2013.01)

(58) Field of Classification Search

CPC .. G09G 3/3291; G09G 3/3644; G09G 3/3648; G09G 2310/0264; G09G 2360/16; G09G 2310/0232; G09G 3/3607; G09G 3/30; G09G 3/3225

See application file for complete search history.

(56) References Cited

U.S. PATENT DOCUMENTS

| | | | | |
|---|---|---|---|---|
| 2017/0110532 | A1 | 4/2017 | Sunkwang et al. | |
| 2018/0357979 | A1* | 12/2018 | Nakamura | G09G 5/10 |
| 2019/0073962 | A1* | 3/2019 | Aflatooni | G09G 3/3275 |

FOREIGN PATENT DOCUMENTS

| | | |
|---|---|---|
| KR | 10-2012-0004766 | 1/2012 |
| KR | 10-2017-0045459 | 4/2017 |

* cited by examiner

*Primary Examiner* — Dennis P Joseph

(74) *Attorney, Agent, or Firm* — H.C. Park & Associates, PLC

(57) ABSTRACT

A display device including a display panel and a data modulator. The display panel includes a main display region, an auxiliary display region adjacent to the main display region in a first direction, and a notch region adjacent to the auxiliary display region in a second direction crossing the first direction, an image not being displayed in the notch region. The data modulator modulates a notch data corresponding to the notch region among an image data.

6 Claims, 6 Drawing Sheets

DISPLAY DEVICE AND METHOD OF DRIVING THE SAME

CROSS REFERENCE TO RELATED APPLICATION

This application claims priority from and the benefit of Korean Patent Application No. 10-2017-0156564, filed on Nov. 22, 2017, which is hereby incorporated by reference for all purposes as if fully set forth herein.

BACKGROUND

Field

Exemplary embodiments relate to electronic devices. More particularly, exemplary embodiments relate to display devices and methods of driving the display devices.

Discussion of the Background

As information technology has developed, the market for display devices, which are connecting media between users and information, is increasing. Accordingly, usage of flat panel displays (FPDs), such as liquid crystal displays (LCDs), organic light-emitting diodes (OLEDs), and plasma display panels (PDPs) has increased.

Improvement of image quality of the display device is desirable in order to enhance convenience for users. Recently, a display device including a display region having various planar shapes derived from a conventional rectangular planar shape has been developed. Changes to the planar shapes of the display region may influence image quality characteristics of the display device.

The above information disclosed in this Background section is only for understanding of the background of the inventive concepts, and, therefore, it may contain information that does not constitute prior art.

SUMMARY

Exemplary embodiments of the present invention provide a display device with improved image quality.

Exemplary embodiments of the present invention provide a method of driving a display device for improving image quality of the display device.

Additional features of the inventive concepts will be set forth in the description which follows, and in part will be apparent from the description, or may be learned by practice of the inventive concepts.

An exemplary embodiment of the present invention provides a display device including a display panel including a main display region, an auxiliary display region adjacent to the main display region in a first direction, and a notch region adjacent to the auxiliary display region in a second direction crossing the first direction, an image not being displayed in the notch region; and a data modulator configured to modulate a notch data corresponding to the notch region among an image data.

The auxiliary display region may include a first auxiliary display region and a second auxiliary display region spaced apart from each other. The notch region may be disposed between the first auxiliary display region and the second auxiliary display region.

A width of the notch region in the second direction may increase along the first direction.

The display panel may further include a corner region facing the notch region with the auxiliary display region in between, and an image may not be displayed in the corner region. The data modulator may be configured to modulate a corner data corresponding to the corner region among the image data.

The width of the corner region in the second direction may increase along the first direction.

The data modulator may be configured to convert the notch data into a predetermined grayscale.

The data modulator may include: a data analyzer configured to analyze an auxiliary data corresponding to the auxiliary display region among the image data; and a data converter configured to convert the notch data based on the analyzed auxiliary data.

The data analyzer may be configured to calculate an average grayscale of the auxiliary data.

The data converter may be configured to convert the notch data into a grayscale greater or less than the calculated average grayscale of the auxiliary data.

The data modulator may include: a pattern detector configured to detect a pattern data corresponding to an image pattern displayed in the auxiliary display region from the image data; a pattern analyzer configured to generate a pattern information about the image pattern from the pattern data; and a data converter configured to convert the notch data based on the pattern information.

The pattern information may be a size of the image pattern or a grayscale of the image pattern.

Another exemplary embodiment of the present invention provides a method of driving a display device including a main display region, an auxiliary display region adjacent to the main display region in a first direction, and a notch region adjacent to the auxiliary display region in a second direction crossing the first direction, an image not being displayed in the notch region, the method including converting a notch data corresponding to the notch region among an image data; and outputting an image using the image data including the converted notch data.

The notch data may be converted into a predetermined grayscale.

The method may further include: analyzing the image data before converting the notch data.

The step of analyzing the image data may include calculating an average grayscale of an auxiliary data corresponding to the auxiliary display region among the image data.

The step of converting the notch data may include converting the notch data into a grayscale greater or less than the calculated average grayscale of the auxiliary data.

The step of analyzing the image data may include: detecting a pattern data corresponding to an image pattern displayed in the auxiliary display region from the image data; and generating pattern information about the image pattern from the pattern data.

The notch data may be converted into a black color or a grayscale less than a grayscale of the pattern data when a color of the image pattern corresponds to one of a red color, a green color, and a blue color.

The notch data may be converted into a black color or an average grayscale of the pattern data when a color of the image pattern corresponds to a combination of at least two of a red color, a green color, and a blue color.

The notch data may be converted into a grayscale less than a grayscale of the pattern data when a color of the image pattern corresponds to one of a white color, a gray color, and a black color.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
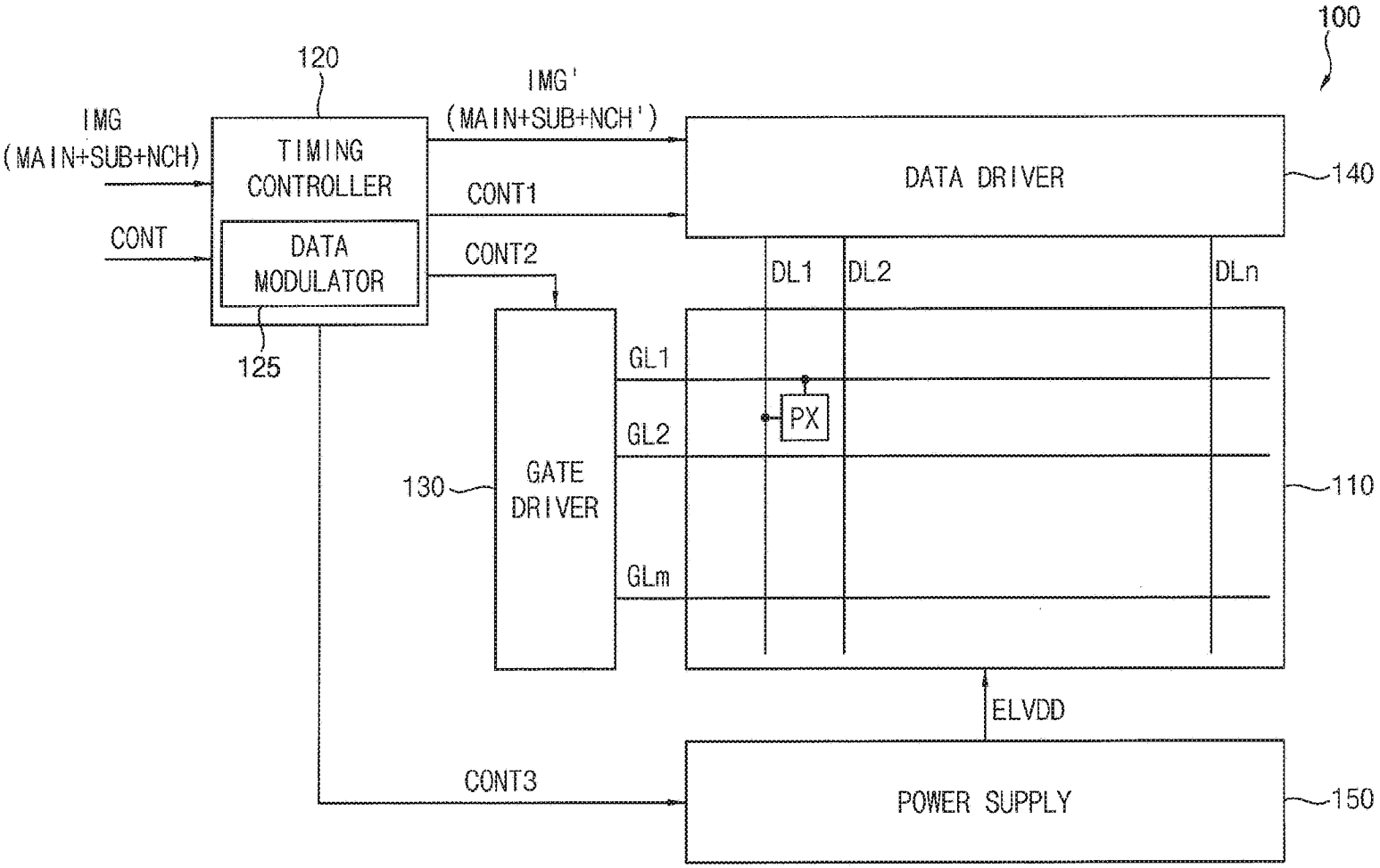
FIG. 1 is a block diagram illustrating a display device according to an exemplary embodiment.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device according to an exemplary embodiment.

Referring to FIG. 1, a display device 100 includes a display panel 110, a timing controller 120, a gate driver 130, a data driver 140, and a power supply 150. The display device 100 displays an image based on an image data IMG supplied from an outside.

The display panel 110 includes a plurality of gate lines GL1-GLm, a plurality of data lines DL1-DLn, and a plurality of pixels PX, where m and n are integers greater than or equal to 2. The gate lines GL1-GLm extend in a row direction, and the data lines DL1-DLn extend in a column direction crossing the row direction. The gate lines GL1-GLm and the data lines DL1-DLn are insulated from each other. The pixels PX are arranged at intersections of the gate lines GL1-GLm and the data lines DL1-DLn, respectively.

The timing controller 120 controls operations of the gate driver 130, the data driver 140, and the power supply 150. The timing controller 120 receives the image data IMG and control signals CONT for controlling a display of the image data IMG from the outside. For example, the control signals CONT may include a vertical synchronization signal, a horizontal synchronization signal, a main clock signal, a data enable signal, and the like. The timing controller 120 supplies a modified image data IMG' generated by processing the image data IMG according to operational conditions of the display panel 110 and first control signals CONT1 to the data driver 140, and supplies second control signals CONT2 to the gate driver 130. For example, the second control signals CONT2 may include a start pulse signal, a clock signal, and the like. Further, the timing controller 120 supplies third control signals CONT3 to the power supply 150. For example, the third control signals CONT3 may include a power control signal and the like.

The timing controller 120 includes a data modulator 125. The data modulator 125 generates the modified image data IMG' by modulating the image data IMG.

The gate driver 130 outputs a gate signal for driving the gate lines GL1-GLm in response to the second control signals CONT2 transmitted from the timing controller 120. The gate driver 130 may include a gate driving integrated circuit (IC). The gate driver 130 is not limited to the gate driving IC in the inventive concepts, and may be realized as a circuit using an oxide semiconductor, an amorphous semiconductor, a crystalline semiconductor, a polycrystalline semiconductor, or the like.

The data driver 140 outputs data voltages for driving the data lines DL1-DLn in response to the modified image data IMG' and the first control signals CONT1 transmitted from the timing controller 120.

The power supply 150 converts a power voltage supplied from the outside into a driving voltage ELVDD according to operational conditions of the display panel 110 in response to the third control signals CONT3 transmitted from the timing controller 120. The power supply 150 supplies the driving voltage ELVDD to the display panel 110.

Figure 2:
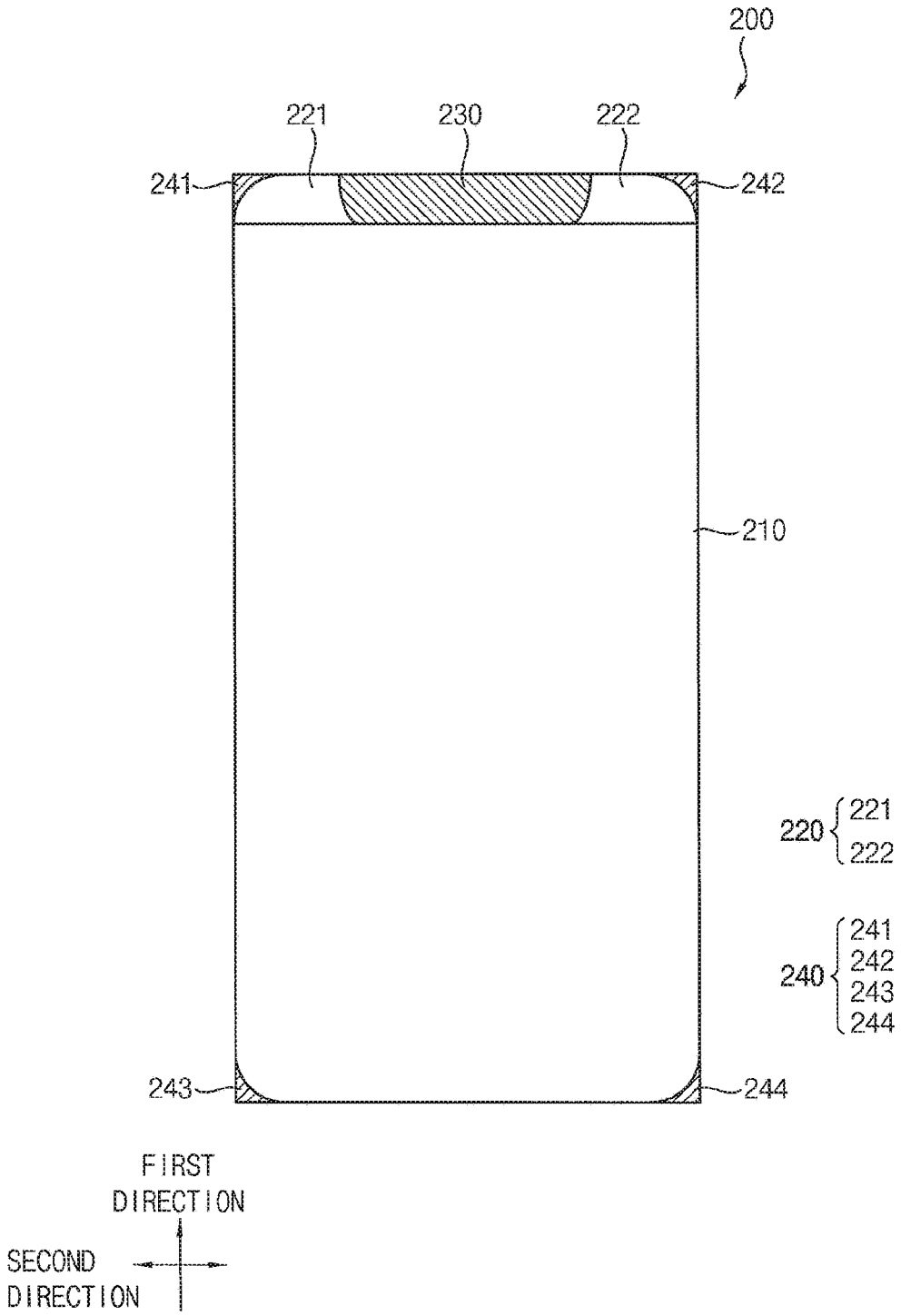
FIG. 2 is a plan view illustrating a display panel according to an exemplary embodiment.

FIG. 2 is a plan view illustrating a display panel according to an exemplary embodiment.

Referring to FIGS. 1 and 2, a display panel 200 includes a display region 210 and 220, and a notch region 230. The display region 210 and 220 includes a main display region 210 and an auxiliary display region 220.

The main display region 210 may be located at a center of the display panel 200. In an exemplary embodiment, the main display region 210 may display an ordinary image such as a video, a still image, a text, or the like.

The auxiliary display region 220 may be adjacent to the main display region 210 in a first direction. In an exemplary embodiment, the auxiliary display region 220 may display an auxiliary image such as a present time, remaining battery life, or the like. In another exemplary embodiment, the auxiliary display region 220 may display a video, a still image, or the like together with the main display region 210.

In an exemplary embodiment, the auxiliary display region 220 includes a first auxiliary display region 221 and a second auxiliary display region 222 spaced apart from each other. The first auxiliary display region 221 and the second auxiliary display region 222 may be adjacent to the main display region 210 in the first direction, and may be spaced apart from each other in a second direction crossing the first direction.

The notch region 230 may be adjacent to the auxiliary display region 220 in the second direction, and may be adjacent to the main display region 210 in the first direction. In an exemplary embodiment, the notch region 230 may be located between the first auxiliary display region 221 and the second auxiliary display region 222.

The notch region 230 may be a non-display region in which an image is not displayed. Accordingly, the display panel 200 may include the display region 210 and 220 having a planar shape in which one side of a rectangular planar shape is depressed.

A width of the notch region 230 in the second direction may increase along the first direction. In other words, the width of the notch region 230 in the second direction may increase along a direction from an inside to an outside of the display panel 200. Accordingly, a width of the auxiliary display region 220 in the second direction may decrease along the first direction.

The image data IMG supplied to the timing controller 120 from the outside includes main data MAIN, auxiliary data SUB, and notch data NCH. The main data MAIN may be supplied to the pixels PX located in the main display region 210, and may correspond to the main display region 210. The auxiliary data SUB is supplied to the pixels PX located in the auxiliary display region 220, and may correspond to the auxiliary display region 220. The notch data NCH is supplied to the pixels PX located in the notch display region 230, and may correspond to the notch display region 230. The data modulator 125 modulates the notch data NCH among the image data IMG.

In an exemplary embodiment, the display panel 200 further includes a corner region 240. The corner region 240 includes a first corner region 241 and a second corner region 242. In an exemplary embodiment, the first corner region 241 may face the notch region 230 with the first auxiliary display region 221 in between, and the second corner region 242 may face the notch region 230 with the second auxiliary display region 222 in between.

The corner region 240 may be a non-display region in which an image is not displayed. Accordingly, the display panel 200 may include the display region 210 and 220 having a planar shape in which corners of a rectangular planar shape are rounded.

A width of the corner region 240 in the second direction may increase along the first direction. In other words, the width of the corner region 240 in the second direction may increase along a direction from an inside to an outside of the display panel 200. Accordingly, a width of the auxiliary display region 220 in the second direction may decrease along the first direction.

In an exemplary embodiment, the corner region 240 may further include a third corner region 243 and a fourth corner region 244. The third corner region 243 and the fourth corner region 244 may face the first corner region 241 and the second corner region 242 with the main display region 210 in between, respectively.

Figure 3:
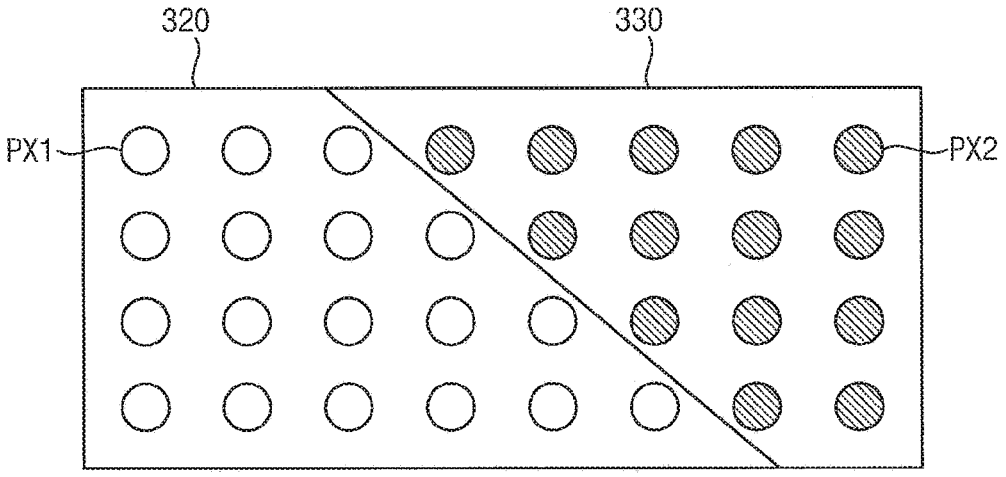
FIG. 3 is a diagram illustrating a portion of a display panel according to an exemplary embodiment.

FIG. 3 is a diagram illustrating a portion of a display panel according to an exemplary embodiment.

Referring to FIGS. 1 and 3, the display panel 110 includes an auxiliary display region 320 and a notch region 330 adjacent to each other.

The pixels PX may include a plurality of first pixels PX1 arranged in the auxiliary display region 320 and a plurality of second pixels PX2 arranged in the notch region 330.

Each of the first pixels PX1 may include a pixel circuit connected to the gate line GL1-GLm and the data line DL1-DLn and an emission element connected to the pixel circuit. Accordingly, each of the first pixels PX1 may emit light based on the data voltage transmitted from the data line DL1-DLn according to the gate signal transmitted from the gate line GL1-GLm and the driving voltage ELVDD.

Each of the second pixels PX2 may include a pixel circuit connected to the gate line GL1-GLm and the data line DL1-DLn, and may not include an emission element. Accordingly, the data voltage transmitted from the data line DL1-DLn according to the gate signal transmitted from the gate line GL1-GLm may be supplied to each of the second pixels PX2, although the second pixels PX2 may not emit light.

The notch region 330 may not display an image even though the image data IMG may include the notch data NCH corresponding to the second pixels PX2 located in the notch region 330. When data voltages corresponding to the notch data NCH are applied to the second pixels PX2, an image defect, such as a horizontal crosstalk, may be generated in the display panel 110. For example, the horizontal crosstalk may be generated in the auxiliary display region 320.

In order to prevent the horizontal crosstalk, the data modulator 125 converts the notch data NCH among the image data IMG including the main data MAIN, the auxiliary data SUB, and the notch data NCH. Accordingly, the data modulator 125 may modulate the image data IMG to generate the modified image data IMG' including a modified notch data NCH'.

In an exemplary embodiment, the data modulator 125 converts the notch data NCH into a predetermined grayscale (or grayscale value). In this case, the predetermined grayscale may be a grayscale determined in consideration of characteristic of the display panel, etc. irrespective of the main data MAIN and the auxiliary data SUB of the image data IMG. Accordingly, the data modulator 125 may convert the notch data NCH corresponding to the second pixels PX2 irrespective of the auxiliary data SUB corresponding to the first pixels PX1.

In another exemplary embodiment, the data modulator 125 may convert the notch data NCH into a white grayscale or an intermediate grayscale between the white grayscale and a black grayscale. Accordingly, a data voltage corresponding to the white grayscale or the intermediate grayscale may be applied to the second pixels PX2. When the notch data NCH is converted into the white grayscale or the intermediate grayscale, the horizontal crosstalk may be reduced or substantially prevented.

Figure 4:
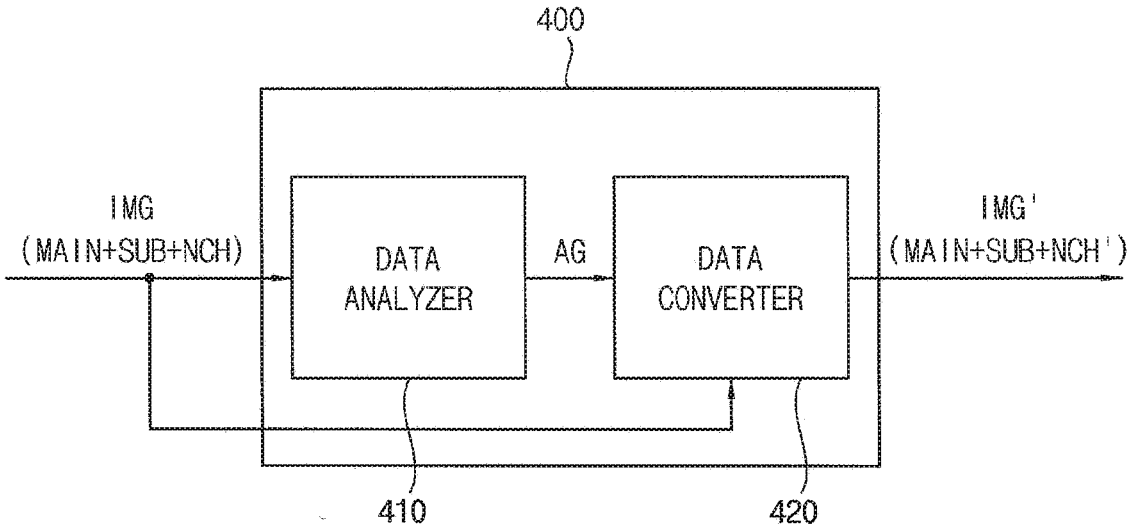
FIG. 4 is a block diagram illustrating a data modulator according to an exemplary embodiment.

FIG. 4 is a block diagram illustrating a data modulator according to an exemplary embodiment.

Referring to FIG. 4, a data modulator 400 includes a data analyzer 410 and a data converter 420.

The data analyzer 410 analyzes the image data IMG supplied from the outside. In an exemplary embodiment, the data analyzer 410 may analyze the auxiliary data SUB among the main data MAIN, the auxiliary data SUB, and the notch data NCH included in the image data IMG.

In an exemplary embodiment, the data analyzer 410 calculates an average grayscale AG of the auxiliary data SUB. The data analyzer 410 provides the calculated average grayscale AG of the auxiliary data SUB to the data converter 420.

The data converter 420 converts the notch data NCH based on the auxiliary data SUB analyzed by the data analyzer 410. In an exemplary embodiment, the data converter 420 generates the modified image data IMG', including the modified notch data NCH' that is converted from the notch data NCH in response to the image data IMG supplied from the outside and the average grayscale AG of the auxiliary data SUB supplied from the data analyzer 410.

In an exemplary embodiment, the data converter 420 converts the notch data NCH into a grayscale greater or less than the average grayscale AG of the auxiliary data SUB. Accordingly, the modified notch data NCH' has a grayscale greater or less than the average grayscale AG of the auxiliary data SUB.

Figure 5:
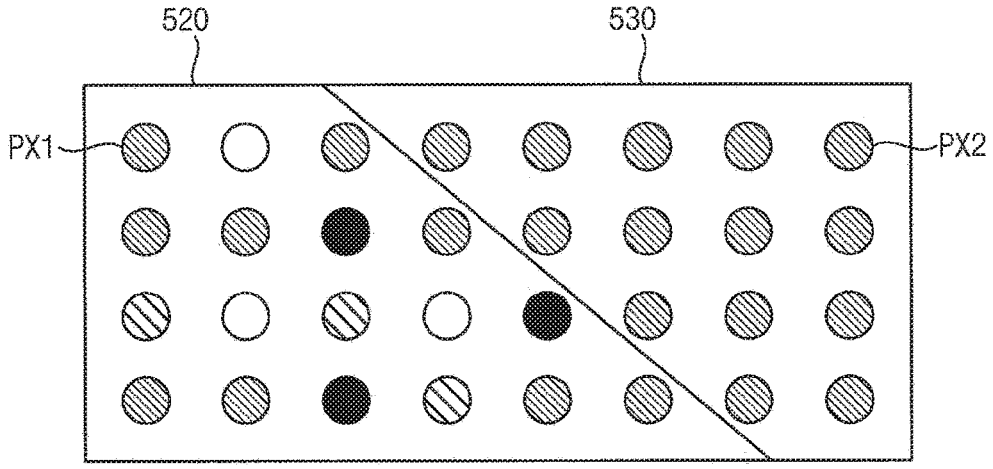
FIG. 5 is a diagram illustrating a portion of a display panel according to an exemplary embodiment.

FIG. 5 is a diagram illustrating a portion of a display panel according to an exemplary embodiment.

Referring to FIGS. 4 and 5, the display panel includes an auxiliary display region 520 and a notch region 530 adjacent to each other.

In an exemplary embodiment, the data analyzer 410 calculates the average grayscale AG of the auxiliary data SUB corresponding to the first pixels PX1. The auxiliary data SUB may include pixel data respectively corresponding to the first pixels PX1, and grayscales of the pixel data may be different from each other. In this case, the data analyzer 410 calculates the average grayscale AG of the auxiliary data SUB, which is an average value of the grayscales of the pixel data different from each other. For example, as shown in FIG. 5, the auxiliary display region 520 may include three first pixels PX1 having 0 grayscale of pixel data, nine first pixels PX1 having 100 grayscale of pixel data, three first pixels PX1 having 200 grayscale of pixel data, and three first pixels PX1 having 255 grayscale of pixel data. In this case, the average grayscale AG of the auxiliary data SUB may be about 125.8.

In an exemplary embodiment, the data converter 420 converts the notch data NCH corresponding to the second pixels PX2 into a grayscale greater or less than the average grayscale AG of the auxiliary data SUB. In this case, the grayscale greater or less than the average grayscale AG of the auxiliary data SUB may be applied to the pixel data respectively corresponding to the second pixels PX2. For example, the grayscales of the pixel data respectively corresponding to the second pixels PX2 may be greater or less than about 125.8.

Figure 6:
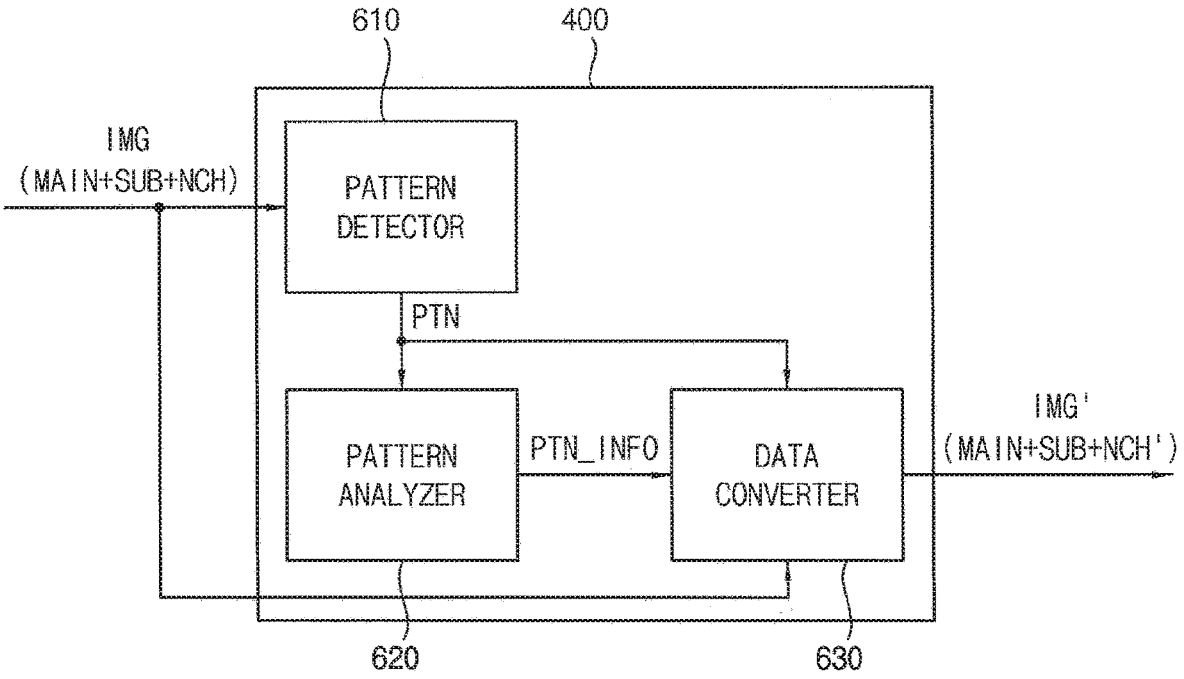
FIG. 6 is a block diagram illustrating a data modulator according to an exemplary embodiment.

FIG. 6 is a block diagram illustrating a data modulator according to an exemplary embodiment.

Referring to FIG. 6, a data modulator 600 includes a pattern detector 610, a pattern analyzer 620, and a data converter 630.

The pattern detector 610 detects a pattern data PTN corresponding to an image pattern displayed at the auxiliary display region from the image data IMG supplied from the outside. The pattern detector 610 generates the pattern data PTN about the image pattern from the auxiliary data SUB included in the image data IMG.

The pattern analyzer 620 generates pattern information PTN_INFO about the image pattern from the pattern data PTN supplied from the pattern analyzer 610. In an exemplary embodiment, the pattern information PTN_INFO may include information such as a size of the image pattern, a grayscale of the image pattern, or the like.

The data converter 630 converts the notch data NCH based on the pattern information PTN_INFO generated from the pattern analyzer 620. In an exemplary embodiment, the data converter 630 generates the modified image data IMG' including the modified notch data NCH' that is converted from the notch data NCH in response to the image data IMG supplied from the outside, the pattern data PTN supplied from the pattern detector 610, and the pattern information PTN_INFO supplied from the pattern analyzer 620.

Figure 7:
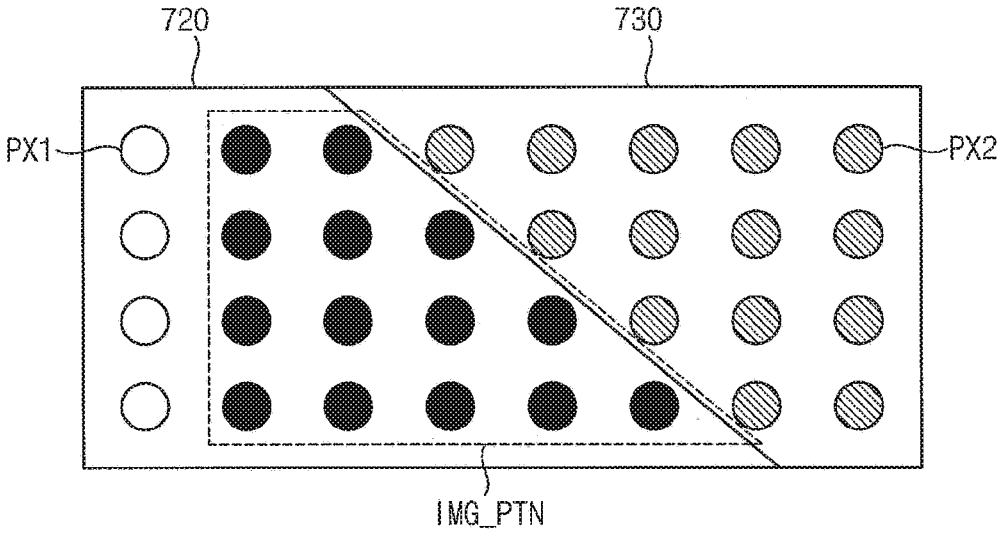
FIG. 7 is a diagram illustrating a portion of a display panel according to an exemplary embodiment.

FIG. 7 is a diagram illustrating a portion of a display panel according to an exemplary embodiment.

Referring to FIGS. 6 and 7, the display panel includes an auxiliary display region 720 and a notch region 730 adjacent from each other.

The pattern detector 610 detects the pattern data PTN corresponding to the image pattern IMG_PTN displayed in the auxiliary display region 720 from the image data IMG. The image pattern IMG_PTN may be formed at a portion of the first pixels PX1 located in the auxiliary display region 720. When the image pattern IMG_PTN is displayed in a portion of the auxiliary display region 720 adjacent to the notch region 730, the quality of the image displayed in the auxiliary display region 720 may be deteriorated, and specifically, horizontal crosstalk may occur in the auxiliary display region 720.

The pattern analyzer 620 generates pattern information PTN_INFO about a size, a grayscale, etc. of the image pattern IMG_PTN, and the data converter 630 converts the notch data NCH corresponding to the second pixels PX2 based on the pattern information PTN_INFO.

In an exemplary embodiment, the data converter 630 converts the notch data NCH according to a color of the image pattern IMG_PTN. For example, the data converter 630 may convert the notch data NCH differently when the color is single, mixed, or achromatic.

When the color of the image pattern IMG_PTN corresponds to a single color (e.g., one of red, green, and blue), the notch data NCH may be converted into a black color or a grayscale less than a grayscale of the image pattern IMG_PTN. For example, when the color of the image pattern IMG_PTN is red, and the grayscale of the pattern data PTN is 255, the notch data NCH may be converted into a black or red color having a grayscale less than 255.

When the color of the image pattern IMG_PTN corresponds to a mixed color (e.g., a combination of at least two of red, green, and blue colors), the notch data NCH may be converted into a black color or an average grayscale of the image pattern IMG_PTN. For example, when the color of the image pattern IMG_PTN is a combination of red and green, and a red grayscale and a green grayscale of the pattern data PTN are 100 and 200, respectively, the notch data NCH may be converted into a black color or the combination of red and green colors respectively having a grayscale of 150.

When the color of the image pattern IMG_PTN corresponds to an achromatic color (e.g., white, gray, or black), the notch data NCH may be converted into a black color or a grayscale less than a grayscale of the image pattern IMG_PTN. For example, when the color of the image pattern IMG_PTN is achromatic, and the grayscale of the pattern data PTN is 255, the notch data NCH may be converted into a black color or a value having a grayscale less than 255.

Figure 8:
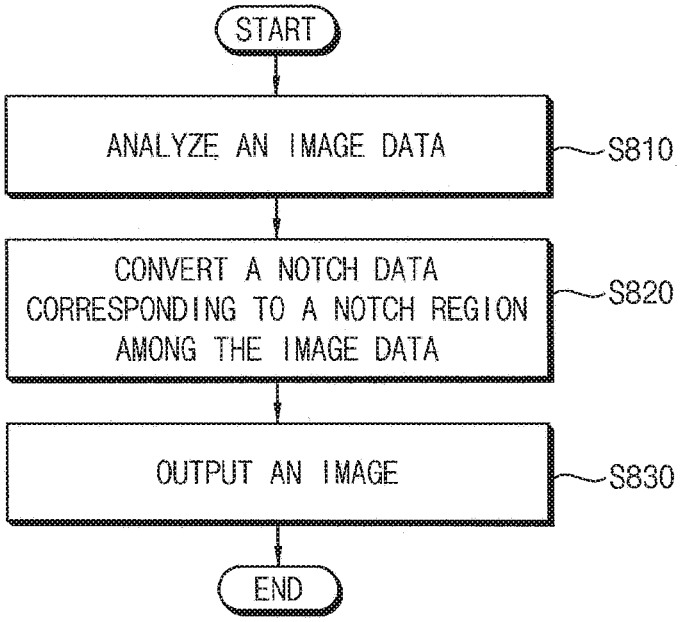
FIG. 8 is a flowchart illustrating a method of driving a display device according to an exemplary embodiment.

FIG. 8 is a flowchart illustrating a method of driving a display device according to an exemplary embodiment.

Referring to FIGS. 1, 2, and 8, in the display device including the main display region 210, the auxiliary display region 220 adjacent to the main display region 210 in the first direction, and the notch region 230 adjacent to the auxiliary display region 220 adjacent to the second direction crossing the first direction, an image not being displayed at the notch region 230, a method of driving the display device according to an exemplary embodiment includes analyzing the image data IMG (S810), converting the notch data NCH corresponding to the notch region 230 among the image data IMG (S820), and outputting an image using the modified image data IMG' that is converted from the notch data NCH (S830).

In an exemplary embodiment, analyzing the image data IMG (S810) may be omitted. In this case, the notch data NCH may be converted irrespective of the main data MAIN and the auxiliary data SUB included in the image data IMG when converting the notch data NCH (S820).

In an exemplary embodiment, converting the notch data NCH (S820) includes converting the notch data NCH into a predetermined grayscale (or grayscale value). Here, the predetermined grayscale may be a grayscale determined in consideration of characteristics of the display panel irrespective of the main data MAIN and the auxiliary data SUB included in the image data IMG.

In an exemplary embodiment, the predetermined grayscale may be a white grayscale or an intermediate grayscale between the white grayscale and a black grayscale. When the notch data NCH is converted into the white grayscale or the intermediate grayscale, the horizontal crosstalk may be reduced or substantially prevented.

In an exemplary embodiment, analyzing the image data IMG (S810) includes calculating an average grayscale of the auxiliary data SUB corresponding to the auxiliary display region 220 among the image data IMG.

In an exemplary embodiment, converting the notch data NCH (S820) includes converting the notch data NCH into a grayscale greater or less than the average grayscale of the auxiliary data SUB calculated when analyzing the image data IMG.

Figure 9:
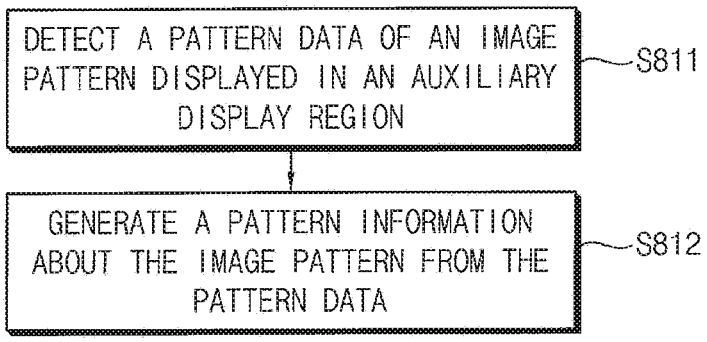
FIG. 9 is a flowchart illustrating analyzation of an image data according to an exemplary embodiment.

FIG. 9 is a flowchart illustrating analyzation of an image data according to an exemplary embodiment.

Referring to FIGS. 1, 2, 8, and 9, analyzing the image data IMG (S810) includes detecting a pattern data corresponding to an image pattern displayed at the auxiliary display region 220 from the image data IMG (S811) and generating a pattern information about the image pattern from the pattern data (S812).

When detecting the pattern data (S811), the pattern data corresponding to the image pattern displayed in the auxiliary display region 220 is detected from the auxiliary data SUB included in the image data IMG. When generating the pattern information (S812), the pattern information, such as a size of the image pattern, a grayscale of the image pattern, etc. may be generated from the pattern data.

Figure 10:
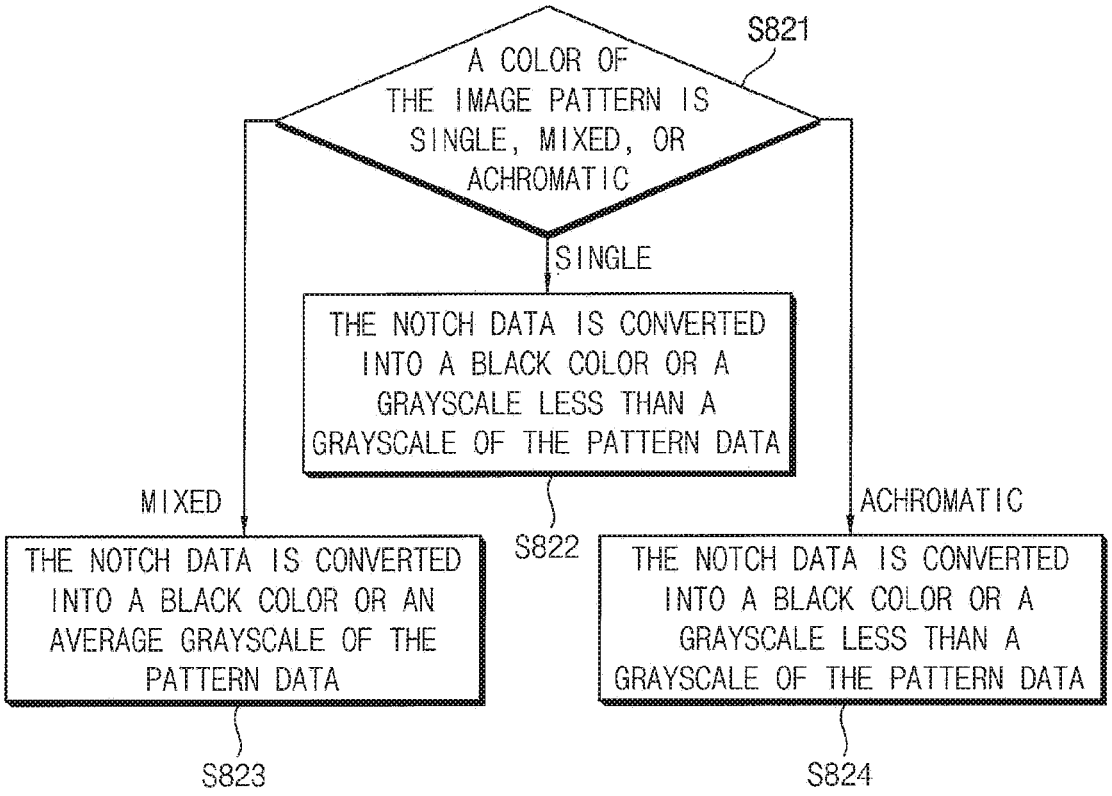
FIG. 10 is a flowchart illustrating conversion of an image data according to an exemplary embodiment.

FIG. 10 is a flowchart illustrating transformation of an image data according to an exemplary embodiment.

Referring to FIGS. 8 and 10, in an exemplary embodiment, converting the notch data (S820) includes determining a color of the image pattern (S821) and converting the notch data NCH according to the color of the image pattern (S822, S823, and S824).

The color of the image pattern may be divided into a single color, a mixed color, or an achromatic color in determining the color of the image pattern (S821).

When the color of the image pattern is the single color (e.g., one of red, green, and blue), the notch data NCH may be converted into a black color or a grayscale less than a grayscale of the image pattern (S822). When the color of the image pattern is the mixed color (e.g., a combination of at least two of red, green, and blue colors), the notch data NCH may be converted into a black color or an average grayscale of the image pattern (S823). When the color of the image pattern is the achromatic color (e.g., white, gray, or black), the notch data NCH may be converted into a black color or a grayscale less than a grayscale of the image pattern (S824).

When outputting the image (S830), the image may be outputted using the modified image data IMG' including the modified notch data NCH' converted when converting the notch data NCH (S820). Accordingly, an image with an improved quality (e.g., in which the horizontal crosstalk is reduced or substantially prevented) may be outputted from the display device.

The display device according to the exemplary embodiments of the inventive concepts may be applied to a display device included in a computer, a notebook, a mobile phone, a smartphone, a smart pad, a PMP, a PDA, an MP3 player, or the like.

Exemplary embodiments include the data modulator being configured to modulate the notch data corresponding to the notch region that is a non-display region among the image data. Therefore, horizontal crosstalk may be reduced or substantially prevented, and image quality of the display device may be improved.

In the method of driving the display device according to the disclosed embodiments, the image data is analyzed, and the notch data corresponding to the notch region that is a non-display region among the image data may be converted. Accordingly, horizontal crosstalk may be reduced or substantially prevented, and an image with improved quality may be displayed.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display panel including a main display region, an auxiliary display region adjacent to the main display region in a first direction, and a notch region adjacent to the auxiliary display region in a second direction crossing the first direction, an image not being displayed in the notch region; and a data modulator configured to modulate a notch data corresponding to the notch region among an image data, wherein:

the data modulator comprises:

a pattern detector configured to detect a pattern data corresponding to an image pattern displayed in the auxiliary display region from the image data;

a pattern analyzer configured to generate a pattern information about the image pattern from the pattern data; and a data converter configured to convert the notch data based on the pattern information;

the pattern information is a grayscale of the image pattern; and the data converter is configured to convert the notch data:

into a black color or a grayscale less than a grayscale of the pattern data when the color of the image pattern corresponds to one of a red color, a green color, and a blue color;

into a black color or an average grayscale of the pattern data when the color of the image pattern corresponds to a combination of at least two of a red color, a green color, and a blue color; and into a black color or a grayscale less than a grayscale of the pattern data when the color of the image pattern corresponds to one of a white color, a gray color, and a black color.

2. The display device of claim 1, wherein the auxiliary display region includes a first auxiliary display region and a second auxiliary display region spaced apart from each other, and wherein the notch region is disposed between the first auxiliary display region and the second auxiliary display region.

3. The display device of claim 1, wherein a width of the notch region in the second direction increases along the first direction.

4. The display device of claim 1, wherein the display panel further includes a corner region facing the notch region with the auxiliary display region in between, and an image is not displayed in the corner region, and wherein the data modulator is configured to modulate a corner data corresponding to the corner region among the image data.

5. The display device of claim 4, wherein a width of the corner region in the second direction increases along the first direction.

6. A method of driving a display device including a main display region, an auxiliary display region adjacent to the main display region in a first direction, and a notch region adjacent to the auxiliary display region in a second direction crossing the first direction, an image not being displayed in the notch region, the method comprising:

analyzing the image data;

converting a notch data corresponding to the notch region among an image data; and outputting an image using the image data including the converted notch data, wherein:

analyzing the image data comprises:

detecting a pattern data corresponding to an image pattern displayed in the auxiliary display region from the image data;

generating a pattern information about the image pattern from the pattern data; and determining a color of the image pattern by dividing the color of the image pattern into a single color, a mixed color, or an achromatic color;

when the color of the image pattern corresponds to one of a red color, a green color, and a blue color, the notch data is converted into a black color or a grayscale less than a grayscale of the pattern data;

when the color of the image pattern corresponds to a combination of at least two of a red color, a green color, and a blue color, the notch data is converted into a black color or an average grayscale of the pattern data; and when the color of the image pattern corresponds to one of a white color, a gray color, and a black color, the notch data is converted into a black color or a grayscale less than a grayscale of the pattern data.

* * * * *